US006425486B1

(12) United States Patent
Andersson et al.

(10) Patent No.: US 6,425,486 B1
(45) Date of Patent: Jul. 30, 2002

(54) CYLINDRICAL SCREEN AND A METHOD OF MANUFACTURING IT

(75) Inventors: Roine Andersson, Furusund; Lars-Göran Rundqvist, Tumba; Jan Backman, Järälla, all of (SE)

(73) Assignee: GL& V Sweden AB, Stockholm (SE)

( * ) Notice: Subject to any disclaimer, the term of this patent is extended or adjusted under 35 U.S.C. 154(b) by 0 days.

(21) Appl. No.: 09/601,282

(22) PCT Filed: Jan. 29, 1999

(86) PCT No.: PCT/SE99/00122

§ 371 (c)(1),
(2), (4) Date: Jul. 31, 2000

(87) PCT Pub. No.: WO99/39046

PCT Pub. Date: Aug. 5, 1999

(30) Foreign Application Priority Data

Jan. 29, 1998 (SE) ..... 9800248

(51) Int. Cl.[7] ..... B07B 1/49

(52) U.S. Cl. ..... 209/406; 209/399; 209/411; 210/498; 29/896.62

(58) Field of Search ..... 209/273, 281, 209/283, 406, 407, 410, 411, 397, 399; 210/402, 403, 498, 499; 29/896.6, 896.62

(56) References Cited

U.S. PATENT DOCUMENTS 5,200,072 A 4/1993 Frejborg et al. ..... 210/498 X
5,513,757 A * 5/1996 Papetti ..... 209/411 X
5,718,826 A * 2/1998 Frejborg ..... 210/402
5,791,495 A * 8/1998 Gero et al. ..... 209/406 X
6,056,126 A * 5/2000 Schabel et al. ..... 209/406

FOREIGN PATENT DOCUMENTS

| | | |
|---|---|---|
| DE | 41 07 905 | 9/1992 |
| GB | 562087 | 6/1944 |
| WO | 93/04797 | 3/1993 |
| WO | 95/16819 | 6/1995 |

* cited by examiner

*Primary Examiner*—Tuan N. Nguyen
(74) *Attorney, Agent, or Firm*—Browdy and Neimark

(57) ABSTRACT

In a pressure screening device for separating undesired particles from a fibre suspension a cylindrical screen (2) is provided. The screen has an outer side and an inner side and is provided with a plurality of projections (19) on the outer side of the screen (2) which extend in the circumferential direction of the screen (2), grooves (17) formed on the inner side of the screen (2) and extending in a direction having an axial component, and screening passages in the form of slots (18) disposed in the area of each groove (17) and diverging from the inner side of the screen (2) towards its outer side. According to the invention, the projections (19), grooves (17) and slots (18) of the screen (2) are produced by working of a substantially planar screen plate bent into cylindrical shape subsequent to the working. Thereby it is possible to form a screen (2) having uniform slots (18), the width of which at the inner side of the screen (2) is only about 0.1 mm. The invention also relates to a method of manufacturing such a screen (2).

19 Claims, 3 Drawing Sheets

CYLINDRICAL SCREEN AND A METHOD OF MANUFACTURING IT

CROSS REFERENCE TO RELATED APPLICATION

The present application is the national stage under 35 U.S.C. 371 of PCT/SE99/00122, filed Jan. 29, 1999.

This invention relates to a cylindrical screen for separating undesired particles from a fibre suspension, namely a screen which has an inner side and an outer side and which is provided with a plurality of circumferentially extending projections on the outer side of the screen, grooves formed on the inner side of the screen and extending in a direction having an axial component, and screening passages in the form of slots disposed in the area of each groove and diverging from the inner side of the screen towards the outer side thereof.

A cylindrical screen of this kind may form part of a pressure screening apparatus of the kind used for cleaning of papermaking pulp. Such a pressure cleaning apparatus conventionally comprises a housing in which the screen is accommodated as a stationary part, and a rotor which is rotatably mounted coaxially inside the screen. A fibre suspension to be freed from undesired particles is fed into an annular space between the rotor and the surrounding cylindrical screen, and the greater part of the fibre suspension is forced through the screening passages of the screen, while the greater part of the undesired particles continues along the annular space and is discharged axially therefrom. Normally, the fibre suspension to be cleaned is fed into the annular space at one axial end of the screen and the undesired particles are discharged at the other axial end of the screen. Within the housing, the screen is surrounded by a compartment in which the cleaned fibre suspension, the accept part, is collected and conveyed to an outlet. At the said other axial end the housing has an outlet for the undesired particles, the reject part.

As stated initially, the screening passages, commonly in the form of elongate slots, diverge from the inner side of the screen towards the outer side thereof. The screening passages may be given that form in connection with cutting them in a planar plate which is then formed into a cylindrical screen by bending. Upon bending of the planar plate into cylindrical shape, the width of the slots is reduced at the inner side of the screen. The more the screening passages diverge, the lesser the risk of the fibres in the fibre suspension becoming stuck in the screening passages and therefore the greater the accept flow through the screen. In order that the best possible cleaning of certain kinds of fibre suspension, such as papermaking pulp containing recycled fibre, may be achieved, the width of the screening passages should not exceed about 0.1 mm at the inner side of the screen.

WO93/04797 discloses a cylindrical screen manufactured as follows: One side of a planar plate is formed with a large number of parallel V-grooves, and backing ribs extending transversely to the grooves are welded to the raised portions separating the grooves. The other side of the plate is also formed with grooves, which are located opposite to the grooves on the first side of the plate. In the bottom of each groove elongate screening passages are formed by milling from the said other side of the plate such that the plate is divided into a multiplicity of bar-like elements held together by the backing ribs. Then the plate and the backing ribs are bent to form a cylindrical screen with the backing ribs extending circumferentially on the outer side of the screen.

The bending operation results in a reduction of the width of the screening passages at the inner side of the screen.

The screen disclosed in WO93/04797 has the following disadvantages:

Firstly, it is not possible to provide screening passages which diverge adequately from the inner side of the screen towards the outer side thereof, because the screening passages are milled from the said other side of the plate so that the screening passages have to have parallel longitudinal walls or even have to be wider at the said second side than at the first side. only when the plate is bent to cylindrical shape will the screening passages diverge slightly from the inner side of the screen towards the outer side thereof.

Secondly, it is very difficult to make the screening passages uniform. The welding of the backing ribs to the raised portions separating the grooves results in stresses in the welds. When the screening passages are milled subsequent to the welding, the stresses will cause variations of the width of the screening passages along the length thereof. Moreover, the welds have to be exactly alike in order that they may produce a uniform bending resistance. Even very small differences between the welds will result in the width of the screening passages varying still more as a result of the bending of the plate into cylindrical shape. Uniform screening passages are a prerequisite for a proper separation of undesired particles from fibre suspensions. Because the screening openings are only one or a few tenths of a millimetre wide, dimensional variations as small as 0.01 mm will have a negative impact on the quality of the separation.

Thirdly, when using a plate of a thickness that is economically acceptable having regard to the screen diameter in each particular case, it is very difficult to mill screening passages narrower than 0.3 mm, and it accordingly is difficult to obtain, as a result of the bending of the plate, screening passages that are only 0.1 mm wide at the inner side of the screen.

The object of the present invention is to provide a cylindrical screen of the kind indicated initially and having uniform screen passages which diverge adequately from the inner side of the screen towards the outer side thereof and which can readily be made with a width of only about 0.1 mm. This object is achieved in accordance with the invention by producing the aforesaid projections, grooves and slots in a screen of the kind defined by working of a substantially planar screen plate bent into cylindrical shape subsequent to the working.

By producing the projections, grooves and slots of the cylindrical screen by working of a planar plate, welding operations in the initial steps of the manufacture of the screen are avoided. Thereby it is possible to achieve uniformity in the width of the screen passages. If the projections are formed by milling, for example, a high dimensional accuracy is achieved, and the projections will be uniform and have a uniform bending resistance. As a result, the screening passages will remain uniform after the bending of the plate. Alternatively, the projections may be formed by rolling of the planar plate. Using a modern production method, such as laser beam machining, makes it possible to shape the screen passages such that they diverge even in the planar plate, that is, before the bending operation is carried out, and the width of their narrow end can be made as small as about 0.22 mm with an accuracy of about 0.01 mm. Owing to the projections, it will be possible to reduce the width of the screening passages at the inner side of the screen to about 0.1 mm as a result of bending the plate into cylindrical shape.

In one embodiment of the invention, the grooves and slots are produced by material-removing working of the screen plate.

In another embodiment of the invention the projections are also produced by material-removing working of the screen plate.

In the above-mentioned embodiments of the invention, it is not necessary for every projection to extend throughout the circumference of the screen. This is so because it is also possible to reduce the width of the screen passages using projections which extend only partly around the screen but overlap one another circumferentially.

However, in a preferred embodiment of the invention, at least one and preferably all of the projections extend throughout the circumference of the screen.

According to a further embodiment of the invention each projection has an outer face and the slots extend between adjacent projections, and the cross-section of the projections as viewed in a longitudinal section of the screen extends integrally from said outer face of the projection to the inner surface of the screen. As an advantageous result, the screen according to the invention is substantially stronger than a screen according to WO93/04797, because the screen according to the invention is solid and unitary throughout the thickness of the cylindrical plate, from the inner side to the outer side, in the area of the projections. At the same time, the projections produce the effect of reducing the width of the screening passages at the inner side of the screen upon bending the plate into cylindrical shape.

A particularly favourable effect as regards the reduction of the width of the screening passages at the inner side of the screen is obtained if the height of the projections is at least twice the thickness of the cylindrical screen plate in the area of a slot.

In a preferred embodiment of the invention, at least one of the riblike projections is wider adjacent its outer face than adjacent the region of the slots. In this embodiment, the cross-sectional surface of a projection as viewed in an axial section through the screen has its center of area at a substantial distance from the inner side of the screen, namely in the radially outer portion of the projection, and as a consequence the reduction of the width of the screening passages will be substantially amplified at the inner side of the screen upon bending of the plate into cylindrical shape. This effect is obtained even if the planar plate used as a starting material for the manufacture of the screen is relatively thin.

The distance between the projections of the screen should be in the range of 10 to 100 mm, preferably within the range of 20 to 40 mm. Moreover, the grooves of the screen on the inner side thereof and the slots should include an angle $\alpha$ in the range of 1 to 40° with a generatrix of the cylindrical outer surface of the screen as indicated in FIG. 2. A screen having grooves thus skewed or oblique enables a more rapid transport of the reject part towards the reject outlet of the screen than does a screen the grooves of which extend exclusively axially and thus do not have any circumferential component.

In order that a good flow of the accept part through the screen may be obtained, the circumferential distance between adjacent slots should be less than 10 mm, preferably 5 mm.

If the screen has slots having a width at the inner side of the screen within the range of 0.05 to 0.2 mm, preferably within the range of 0.07 to 0.15 mm, the screen is very well suited for separating undesired particles from papermaking pulp containing recycled fibre.

The invention is not limited to a screen only having screening passages in the shape of straight slots. Thus, at least some of the screening passages may extend along a be wave shaped path. Owing to the projections, the width of wave shaped slots will also be reduced at the inner side of the screen upon bending the screen into cylindrical shape. However, if the wave shaped slots are formed by laser beam machining, it is easy to vary the width of each slot along the length thereof such that the width of the slot will be constant throughout the length of the slot after the planar screen plate has been bent into cylindrical shape.

The invention also relates to a method of manufacturing a cylindrical screen for separating undesired particles from a fibre suspension, the method including the following manufacturing steps:

forming on the first side of a planar plate having a first and a second side a plurality of parallel grooves by material-removing working of the plate, forming slots in the planar plate in the area of each groove by cutting the plate, and bending the plate into cylindrical shape such that the grooves will be on the inner side of the resulting cylindrical body.

The method according to the invention is characterised in that a number of projections extending in a direction substantially transverse to the grooves are formed on the second side of the planar plate by material-removing working of the plate prior to its bending into cylindrical shape.

In the method according to the invention, at least one and preferably all of the projections may be formed such that subsequent to the bending of the plate to cylindrical shape, the projections will extend throughout the circumference of the screen.

In the screen according to the invention the slots may advantageously be formed by laser beam or water jet machining.

Preferably, the slots are shaped such that they diverge from the first side of the planar plate towards the second side.

The invention will be described in greater detail below with reference to the accompanying drawings, in which.

Figure 1:
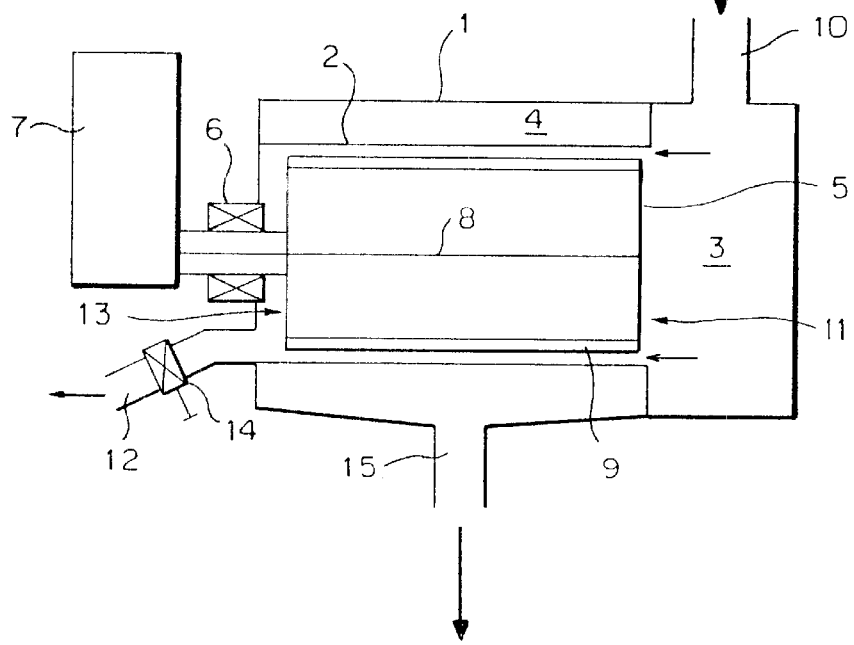
FIG. 1 is a diagrammatic illustration of a pressure screening apparatus including a cylindrical screen according to the invention.

FIG. 1 shows a pressure screening apparatus for freeing a fibre suspension from undesired particles contained therein. The pressure screening apparatus comprises a hollow housing 1, a stationary circular cylindrical screen 2 accommodated in the housing 1 and dividing the interior of the housing 1 into a compartment 3 for fibre suspension to be cleaned and an annular compartment 4 for cleaned fibre suspension. A rotor 5 which is journalled in the housing by means of a bearing 6 and is coaxially accommodated in the interior of the screen 2 is rotatable about an axis 8 by means of a motor 7. The rotor 5 is provided with rotor blades or wings 9 (four such wings are shown, but the number may be greater or smaller than four) which extend axially along the rotor 5 and are slightly spaced from the screen 2. These rotor wings 9 serve to prevent clogging of the screening passages of the screen 2 and to produce a circumferential suspension flow inside the screen 2.

Compartment 3 has an inlet 10 for feeding the fibre suspension to be cleaned to an axial inlet end 11 of the screen 2. Moreover, compartment 3 has a reject outlet 12 for discharging separated contaminants from an axial reject end 13 of the screen 2. In the reject outlet 12 a valve 14 for adjusting the reject flow is provided. The annular compartment 4 has an accept outlet 15 for discharging the cleaned suspension.

Figure 2:
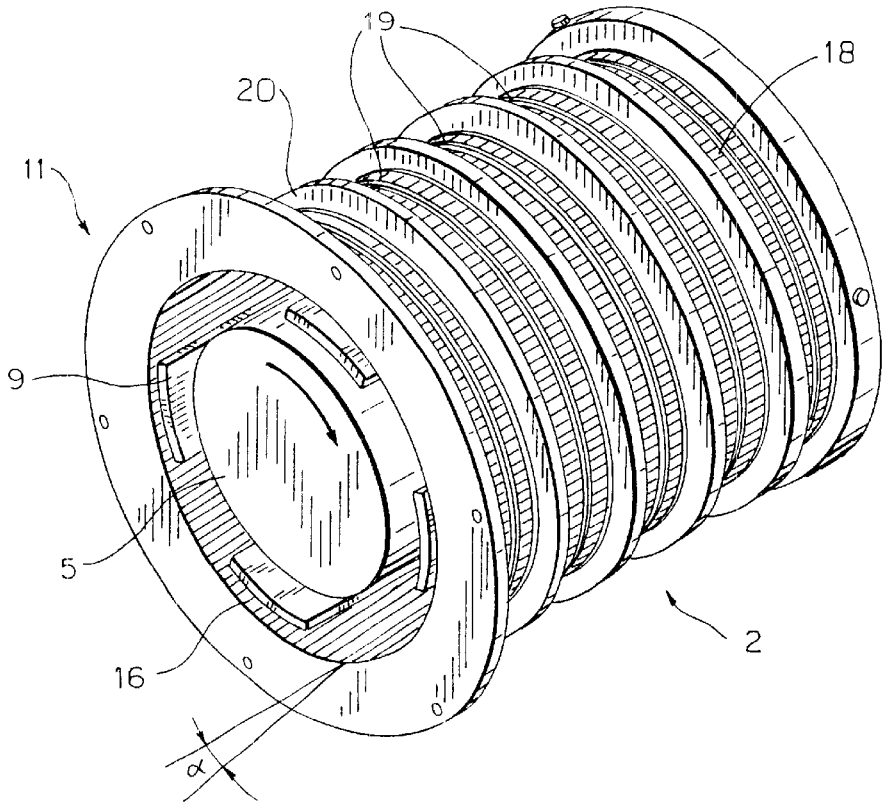
FIG. 2 is a more detailed illustration of the cylindrical screen according to the invention.

FIG. 2 shows the cylindrical screen 2 of an embodiment of the invention and the rotor 5 inside the screen 2, the direction of rotation of the rotor being indicated by arrows. On its inner side, the screen has a multiplicity of elongate raised portions or ridges 16 which define between then grooves or channels 17 (see FIG. 4) distributed over the entire circumference of the screen 2 and extending substantially the entire axial length of the screen. The distance between adjacent grooves 17 is within the range of 3 to 10 mm, and preferably the distance is about 5 mm. Each groove 17 extends obliquely to the longitudinal direction of the screen and forwardly in the direction of rotation of the rotor 5, as viewed from the inlet end 11 of the screen 2 towards the reject end 13. The flanks of the elongate raised portions or ridges 16 form flow deflecting elements for the fibre suspension containing undesired particles. Alternatively, the screen 2 may be formed with grooves 17 extending parallel to the longitudinal direction of the screen. In the bottom walls of the grooves 17, screening passages in the shape of slots 18 are provided which are thus disposed side by side in the circumferential direction of the screen 2. Each slot 18 is about 30 mm in length along its groove 17, but its length may be different.

Throughout its outer side the screen 2 is provided with uniformly spaced-apart riblike projections 19 extending circumferentially about the screen 2. In the illustrated embodiment, each projection 19 extends all the way round the screen 2. On every third projection 19 (see FIG. 2), a reinforcing ring 20 is secured by welding subsequent to bending the screen plate into cylindrical shape. However, such reinforcing rings are not always necessary in the cylindrical screen according to the invention.

All of the elongate raised portions or ridges 16 and projections 19 of the screen 2 are formed i a single planar plate, but it is within the scope of the invention to construct the screen 2 from a plurality of separate, releasably interconnected cylindrical screen sections. In that case, because the screen 2 is subject to more intense wear at the reject end 13 than at the inlet end 11, the screen may be renovated cheaply by substituting a new screen section only for that screen section which is closest to the reject end 13. In addition, such a segmented screen may be adapted to different operating conditions by interconnecting screen segments having different patterns of screening passages and/or different arrangements of grooves 17 on the inner side of the screen segments.

In operation, with the screen 2 mounted in the pressure screening apparatus as shown in FIG. 1, the drive motor 7 drives the rotor 5 so that the rotor wings 9 move in a relatively narrow cylindrical path which is coaxial with the screen 2 and runs in closely spaced relation to the inner side of the screen. The fibre suspension is screened through the slots 18, and when the rotor wings 9 move along the inner side of the screen 2 closely spaced from the elongate raised portions or ridges 16, pressure impulses are generated in the grooves 17. These pressure impulses create a turbulent flow in the fibre suspension, thereby counteracting clogging of the slots 18 with fibres. If the screen 2 is provided with oblique elongate raised portions or ridges 16 as in this case, the pressure impulses also contribute to moving undesired particles in the fibre suspension towards the reject end 13 of the screen 2.

Figure 3:
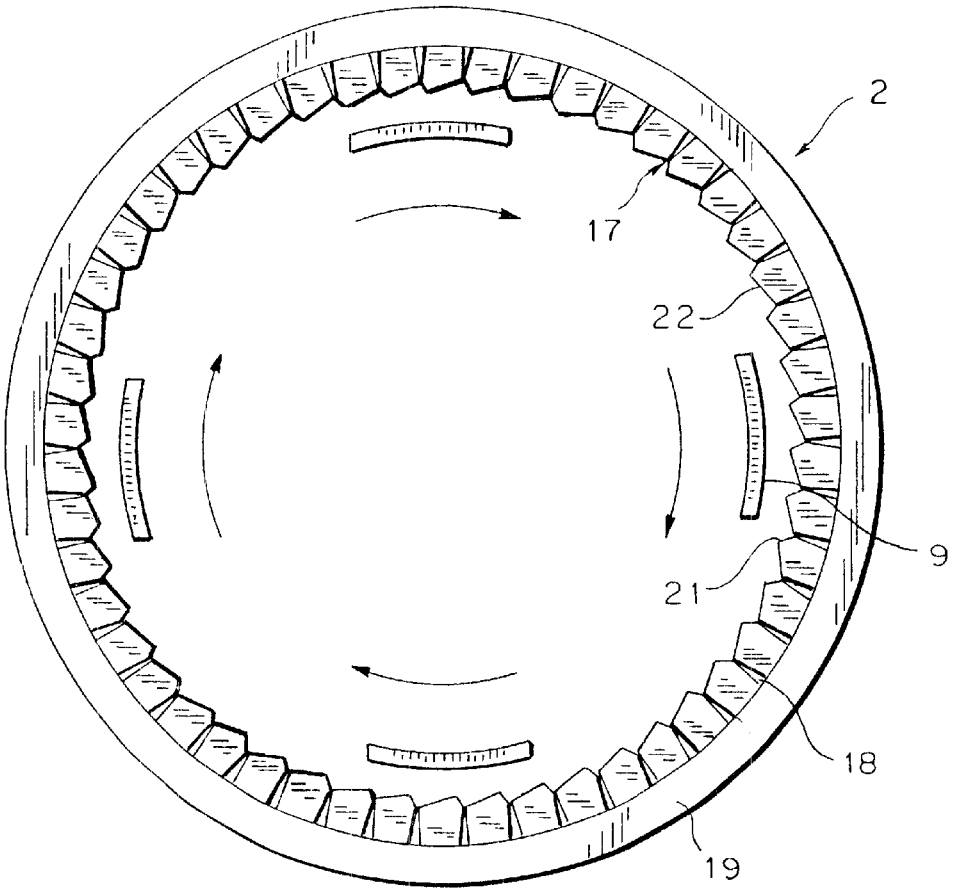
FIGS. 3 to 6 show longitudinal sectional views, taken in an axial plane indicated by line V—V in FIG. 4, of two embodiments of cylindrical screens according to the invention.

FIG. 3 shows a diagrammatic cross-sectional view of a cylindrical screen 2 according to the present invention. The screen consists of an initially planar and rectangular plate which is bent into cylindrical shape and into which parallel grooves 17 have been milled such that the inner surface of the screen has a wave shaped or saw-tooth contour. The raised portions or ridges 16 remaining between the grooves 17 have steep flanks 21 which can serve as flow-diverting elements, and moderately sloping back surfaces 22. It is possible to reverse the direction of rotation of the rotor 5 and its wings 9 so that the sloping back surfaces 22 may act as flow-diverting elements, albeit with reduced effectiveness compared with the steep flanks 21.

In the area of each groove 17, the screen 2 has a screening passage in the shape of a slot 18 which diverges from the inner side of the screen towards the outer side thereof.

A projection 19 extends along the outer surface of the screen 2 throughout the screen circumference.

Figure 4:
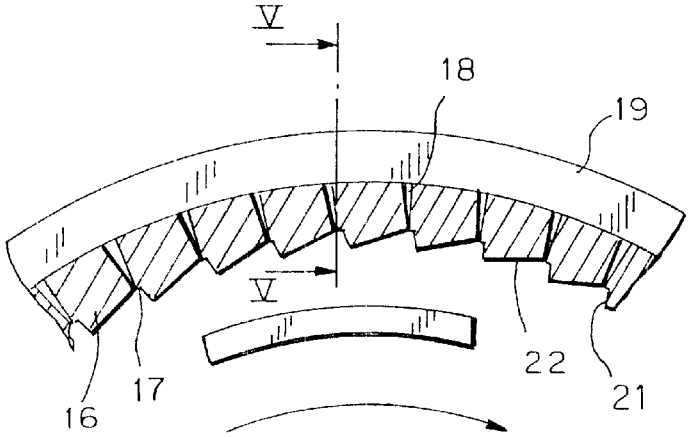

FIG. 4 diagrammatically shows an enlarged portion of the cross-section of the screen shown in FIG. 3.

Advantageously, the screen 2 can be manufactured in the following manner. On one side of a rectangular planar metal plate of uniform thickness a plurality of parallel channels or grooves 17 are formed by material-removing working of the plate, preferably by milling. Such grooves 17 extend the entire length of the plate and are evenly distributed across the entire width of the plate.

A generally V-shaped cross-section is conferred on each groove 17 such that the raised portions or ridges 16 remaining between the grooves will have steep flanks 21 on one side and moderately sloping back surfaces 22 on opposite sides of the crests of the ridges.

The distance separating the ridges is 5mm, for example.

Throughout the opposite side of the planar plate, a number of uniformly spaced-apart riblike projections 19 extending circumferentially, transversely of the grooves 17 are formed by material-removing working of the plate, preferably milling.

The planar plate is then provided with screening passages in the form of slots 18 which diverge from the first-mentioned side of the plate towards the opposite side. The slots 18 are cut by means of a laser beam which is first directed such that it is inclined in one direction relative to the plate at the first-mentioned side and a first cut is made in the bottom of each groove 17. Then the laser beam is inclined in the opposite direction at the same angle to the plate, and a second cut is made in the bottom of the same groove 17. When the second cut is made, the laser beam is moved along the same line on or near the first-mentioned side as during the first cut so that a piece of material of triangular cross-section is cut from the plate.

In this way, a screening passage or slot 18 is made which diverges from the first-mentioned side of the planar plate towards the opposite side. The width of the slots 18 at the bottom of the grooves 17 is about 0.2 mm.

Finally, the plate now provided with grooves 17, slots 18 and projections 19 is bent into cylindrical shape such that the grooves 17 will be on the inner side and the projections 19 will be on the outer side of the resulting cylindrical body.

Upon bending of the plate into cylindrical shape, the width of the slots 18 at the inner side of the screen 2 will be reduced owing to the projections 19. It is possible, therefore, to form slots 18 having a width of only about 0.1 mm at the inner side of the screen and a dimensional variation not greater than about 0.01 mm along the lengths of the slots.

Figure 5A:
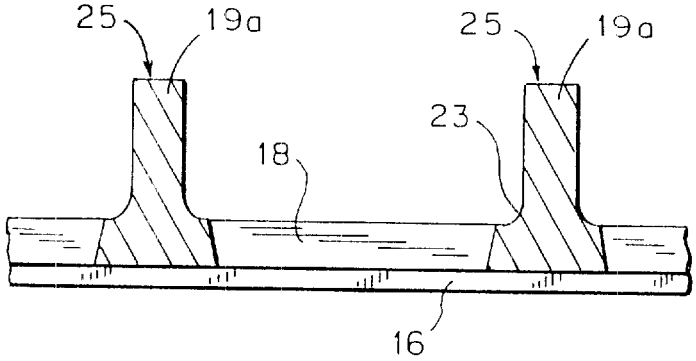
Figure 5B:
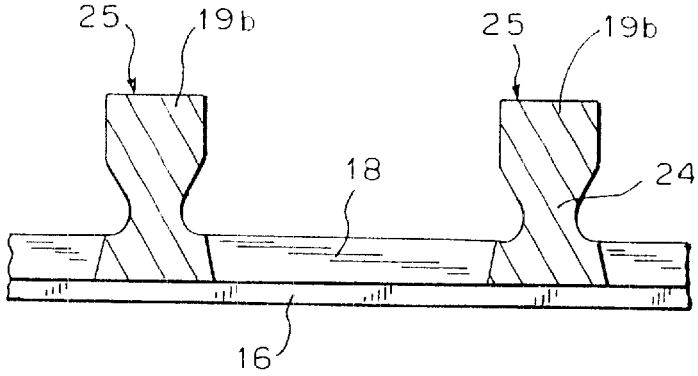

FIGS. 5*a* and 5*b* show riblike projections 19*a* and 19*b*, respectively, of two different embodiments. Each projection 19*a* in FIG. 5*a* has a rectangular cross-section, and on opposite sides of the projection 19*a* there is a rounded transition 23 to the portion of the plate provided with slots 18 and ridges 16.

In a preferred embodiment of the invention illustrated in FIG. 5*b*, the cross-section of the projections 19*b* is substantially rectangular in the upper portion but has a reduced section or waist 24 adjacent the transition to the portion of the plate provided with slots 18 and ridges 16. Each projection 19*a* or 19*b* has a cylindrical outer face 25 directed away from the axis 8 of the cylindrical screen 2.

Figure 6:
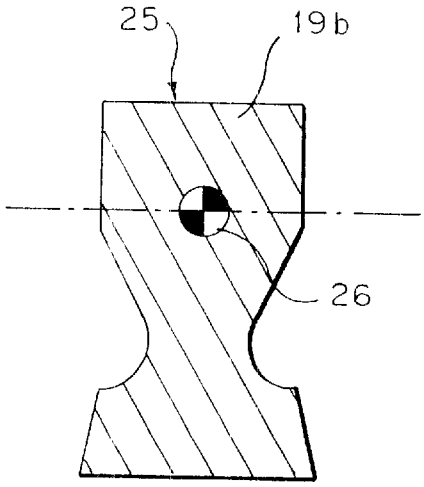

FIG. 6 shows a cross-section of a projection 19*b* according to FIG. 5*b* and of a section of the screen plate separating two adjacent screening slots 18.

When the plate is bent into cylindrical shape, the bending resistance or stiffness of the plate is primarily determined by cross-sections of this kind. The projection 19*b* of FIG. 5*b* is shaped such that the centre of area 26 of the cross-sectional surface of the projection is more remote from the axis 8 of the screen 2 than is the centre of area of the corresponding cross-sectional surface in a screen having projections 19*a* according to FIG. 5*a*, it being understood that the projections 19*a* and 19*b* are of equal heights.

In FIG. 5*a*, see also FIG. 6, the centre of area of the cross-sectional surface of the projections 19*a* is somewhat closer to the axis 8 of the cylindrical screen 2 than is the half-height level of the cross-sectional surface, i.e. the imaginary axially extending line that bisects the cross-sectional surface.

In FIG. 6 is schematically shown that the centre of area 26 of the cross-sectional surface of the projection 19*b* is more remote from the axis 8 of the cylindrical screen 2 than is the half-height level of the cross-sectional surface.

Upon bending of the plate into cylindrical shape, the neutral bending zone, i.e. the imaginary circumferential surface concentric with the circular cylindrical screen in which the plate is neither compressed or elongated, will run through the centre of area 26 (this imaginary surface is represented by a dash-dot line in FIG. 6). By displacing the centre of area away from the axis 8 of the screen 2 through a suitable design of the projections 19*b*, the compression of the plate at the side that will become the inner side of the screen 2 to be manufactured will be greater than the elongation of the plate at the side that will become the outer side of the screen 2 to be manufactured. It is therefore possible to calculate and control the reduction of the width of the slots 18 at the inner side of the screen 2 by designing the aforesaid cross-section such that its centre of area 26 will be at the desired location.

For example, the slot width can be reduced from 0.2 mm in the planar plate to 0.1 mm in the cylindrical plate if the diameter of the screen is 400 mm and the distance between adjacent projections 19*b* is about 23 mm and the projections are shaped as shown in FIG. 5*b*. In the illustrated exemplary embodiment, the projections 19*b* are 11,5 mm high and 8 mm wide, the portion of the plate provided with grooves 17 and slots 18 is 3.5 mm thick, the depth of the grooves 17 is about 1 mm and the distance between adjacent slots 18 in the same groove 17 is about 5 mm.

What is claimed is:

1. A cylindrical screen for separating undesired particles from a fibre suspension, said screen having an inner side and an outer side and provided with a plurality of circumferentially extending projections (19) on the outer side of the screen, grooves (17) formed on the inner side of the screen and extending in a direction having an axial component, and screening passages in the form of slots (18) disposed in the area of each groove (17) and diverging from the inner side of the screen towards the outer side thereof, the projections (19), grooves (17) and slots (18) being produced by removing material from a substantially planar screen plate that is bent into cylindrical shape subsequent to the material removal, characterised in that each of the projections (19) has an outer face (25) and at least some of the projections (19*b*) are formed with a cross-sectional configuration such that their cross-sectional surface is wider adjacent its outer face (25) than adjacent the region of the slots (18).

2. A screen according to claim 1 in which at least one of the projections (19) extends throughout the circumference of the screen.

3. A screen according to claim 1 in which the slots (18) extend between adjacent projections (19) and in which the cross-section of the projections (19) as viewed in an axial section through the screen extends integrally from said outer face (25) of the projections (19) to the inner surface of the screen.

4. A screen according to claim 1 in which the height of the projections (19) is at least twice the thickness of the screen in the area of a slot (18).

5. A screen according to claimed 3 in which the cross-sectional surface of at least one of the projections has a center of area (26) that is located radially outwardly of an imaginary axial line bisecting the cross-sectional surface.

6. A screen according to claim 1 in which the distance between adjacent projections (19) is in the range of 10 to 100 mm.

7. A screen according to claim 1 in which the grooves (17) on the inner side of the screen and the slots (18) include anangle in the range of 1–40° with a generatrix of the outer side of the cylindrical screen (2).

8. A screen according to claim 1 in which the circumferential distance between adjacent slots (18) is less than 10 mm.

9. A screen according to claim 1 in which the width of the slots (18) at the inner side of the screen is in the range of 0.05 to 0.20 mm.

10. A screen according to claim 1, in which at least some of the slots (16) are wave shaped.

11. A screen according to claim 1 in which the distance between adjacent projections (19) is in the range of 20 to 40 mm.

12. A screen according to claim 1 in which the circumferential distance between adjacent slots (18) is about 5 mm.

13. A screen according to claim 1 in which the width of the slots (18) at the inner side of the screen is in the range of 0.07 to 0.15 mm.

14. A method of manufacturing a cylindrical screen for separating undesired particles from a fibre suspension, including the following manufacturing steps:

forming on the first side of a planar plate having a first and a second side a plurality of parallel grooves (17) by material-removing working of the plate, forming on the second side of the planar plate a number of projections (19) extending in a direction substantially transverse to the grooves (17) by material-removing working of the plate prior to its bending into cylindrical shape forming slots (18) in the planar plate in the area of each groove (17) by cutting the plate, and bending the planar plate into cylindrical shape such that the grooves (17) will be on the inner side of the resulting cylindrical body and the projections (19) will be on the outer side, characterised by forming the projections (19) with larger width adjacent their outer, outwardly directed ends than adjacent the region of the slots (18).

15. A method according to claim 14 in which at least one of the projections (19) is formed such that subsequent to the bending of the plate into cylindrical shape the projection will extend throughout the circumference of the screen.

16. A method according to claim 14 in which the slots (18) are formed by laser beam machining.

17. A method according to claim 14 in which the slots (18) are formed by water jet machining.

18. A method according to claim 16 in which the slots (18) are shaped such that they diverge from the first side of the planar plate towards the second side.

19. A method according to claim 14 in which at least one of the projections **(19*b*) is formed with a cross-sectional configuration such that their cross-sectional surface has a center of area (26)** that is located radially outwardly of an imaginary axial line bisecting the cross-sectional surface.

* * * * *